US012318659B2

(12) United States Patent
Murray

(10) Patent No.: US 12,318,659 B2
(45) Date of Patent: Jun. 3, 2025

(54) ARCING EXERCISE STATION FOR LEGS

(71) Applicant: Cameron M. Murray, Seneca, SC (US)

(72) Inventor: Cameron M. Murray, Seneca, SC (US)

( * ) Notice: Subject to any disclaimer, the term of this patent is extended or adjusted under 35 U.S.C. 154(b) by 225 days.

(21) Appl. No.: 18/204,759

(22) Filed: Jun. 1, 2023

(65) Prior Publication Data

US 2024/0024733 A1 Jan. 25, 2024

Related U.S. Application Data

(60) Provisional application No. 63/390,725, filed on Jul. 20, 2022.

(51) Int. Cl.
*A63B 23/04* (2006.01)
*A63B 21/00* (2006.01)

(52) U.S. Cl.
CPC .... *A63B 23/0488* (2013.01); *A63B 21/00065* (2013.01); *A63B 21/154* (2013.01); *A63B 2225/093* (2013.01)

(58) Field of Classification Search
CPC ..... A63B 21/00058; A63B 21/00061; A63B 21/00065; A63B 21/005; A63B 21/0552; A63B 21/0628; A63B 21/08; A63B 21/151; A63B 21/152; A63B 21/154; A63B 21/4034; A63B 21/4045; A63B 22/201; A63B 2022/206; A63B 23/03508; A63B 23/0405; A63B 23/0488; A63B 2023/006; A63B 26/00; A63B 26/003; A63B 2208/0209; A63B 2210/00; A63B 2210/50; A63B 2225/093; A63B 2244/106
See application file for complete search history.

(56) References Cited

U.S. PATENT DOCUMENTS 3,235,255 A * 2/1966 Leflar ..... A63B 21/0724 482/104
4,149,713 A * 4/1979 McLeod ..... A63B 23/03533 601/24
4,176,836 A * 12/1979 Coyle ..... A63B 21/068 482/96
4,354,675 A * 10/1982 Barclay ..... A63B 21/0632 482/99
4,592,545 A 6/1986 Sagedahl et al.
4,598,907 A * 7/1986 Ross ..... A63B 21/06 482/133
4,720,103 A * 1/1988 Palladino, Jr. ..... A63B 69/34 473/438

(Continued)

FOREIGN PATENT DOCUMENTS

CN 112843601 A * 5/2021 ..... A63B 21/00058
CN 113663292 A * 11/2021 ..... A61H 1/0218

(Continued)

*Primary Examiner* — Gary D Urbiel Goldner
(74) *Attorney, Agent, or Firm* — Thrive IP

(57) ABSTRACT

A standing exercise device employs a rolling carriage that a user pushes with either foot along an adjustable arc to develop strength and flexibility of the hip and leg muscles. Weights or resistance bands are attached to the carriage to provide various degrees of resistance. The height and angle of the arc are adjustable to accommodate different users and their exercise, flexibility, and/or rehabilitation needs.

20 Claims, 8 Drawing Sheets

(56) References Cited

U.S. PATENT DOCUMENTS 4,733,858 A * 3/1988 Lan ..... A63B 21/4047 482/53
4,781,372 A * 11/1988 McCormack .... A63B 23/03541 482/70
4,828,252 A * 5/1989 Bowen ..... A63B 21/0628 482/106
4,842,270 A * 6/1989 Lange ..... A63B 21/154 482/56
4,850,585 A 7/1989 Dalebout
5,242,344 A 9/1993 Hundley
7,833,134 B2 11/2010 Gordon
8,043,199 B1 * 10/2011 Barker ..... A63B 23/0216 482/142
8,702,573 B2 4/2014 Hockridge et al.
8,870,726 B2 * 10/2014 Watterson ..... A63B 22/14 482/140
9,056,218 B2 6/2015 Zoltak
9,789,351 B2 * 10/2017 Lalaoua ..... A63B 21/4045
10,773,120 B2 * 9/2020 St. Cyr ..... A63B 21/00069
10,850,158 B2 12/2020 Lagree et al.
11,247,092 B2 2/2022 Albert Garcia
2006/0116249 A1 6/2006 Dibble et al.
2007/0243979 A1 10/2007 Hand
2008/0004163 A1 1/2008 Husted et al.
2009/0163331 A1 * 6/2009 Lacher ..... A63B 69/22 482/98
2010/0099542 A1 * 4/2010 Fernandez ..... A63B 22/203 482/142
2012/0053028 A1 * 3/2012 Campanaro ..... A63B 23/0205 482/131
2013/0095981 A1 * 4/2013 Chung-Ting ..... A63B 22/205 482/66
2013/0245510 A1 9/2013 Zaborowski
2014/0121083 A1 5/2014 Pierce
2014/0194260 A1 * 7/2014 Campanaro ..... A63B 21/4043 482/131
2015/0202484 A1 * 7/2015 Lalaoua ..... A63B 23/0211 482/130
2015/0367173 A1 * 12/2015 Ellis ..... A63B 23/0227 482/133
2016/0082315 A1 3/2016 Carter et al.
2016/0263427 A1 9/2016 Mueller et al.
2017/0014667 A1 * 1/2017 Barnett ..... A63B 23/03525
2017/0014678 A1 * 1/2017 Lalaoua ..... A63B 21/068
2022/0111246 A1 4/2022 Ellis
2022/0134172 A1 5/2022 Henniger
2022/0168609 A1 6/2022 Nakamura
2022/0176194 A1 6/2022 Barragan
2025/0001273 A1 * 1/2025 Steiner ..... A63B 22/0023

FOREIGN PATENT DOCUMENTS

DE 102013105500 A1 * 12/2014 ..... A63B 21/0622
WO WO-0078405 A1 * 12/2000 ..... A63B 23/00

* cited by examiner

ARCING EXERCISE STATION FOR LEGS

CROSS REFERENCE TO RELATED APPLICATIONS

This utility patent application claims benefit of U.S. Provisional Patent Application Ser. No. 63/390,725 filed in the United States Patent and Trademark Office on Jul. 20, 2022, which is incorporated in its entirety by reference thereto.

BACKGROUND OF THE DISCLOSURE

Exercise and conditioning equipment for the human body is ubiquitous. Free weights, strength training stations and stands, and flexibility training aids that use straps, bands, and bars are well known. However, most equipment is cumbersome, requires assistance, and may even be dangerous, for instance, if an elastic band connected to a doorway slips. Still further, exercise "gyms" that combine upper and lower body exercise equipment are focused on muscle building rather than also increasing flexibility or rehabilitating muscles, ligaments, and the like. Moreover, leg and hip exercise equipment is often limited to seated arrangements that target limited muscles and have restricted adjustability.

What is needed in the exercise, conditioning, and rehabilitation industries is a standing arrangement for developing both strength and flexibility of hip and leg muscles.

BRIEF SUMMARY OF THE DISCLOSURE

The present disclosure is directed in general to a standing exercise device that employs a rolling carriage with a foot plate that a user can push with either foot to cause the carriage to travel along an adjustable arc. Resistance loads such as weights are attached to a pulley system connected to the rolling carriage to provide various degrees of resistance to develop strength and flexibility of hip and leg muscles. The height and angle of the arc are adjustable to accommodate different users and their exercise, flexibility, and/or rehabilitation needs. Further, adjustable handlebars are provided to provide stability for different users of all ages and physical abilities.

In one embodiment according to the disclosure, an arcing system for leg extensions may include a tower having a height adjustment mechanism; a rail system; an arc system having a first end and a second end, the first end adjustably attached to the height adjustment mechanism and the second end adjustably attached to the rail system; a resistance load; and a carriage slidably disposed on the arc system and connected to the resistance load such that when the carriage is engaged by a user and pushed along the arc system, the resistance load opposes exertion by the user. The first end of the arc system can be raised and lowered on the height adjustment mechanism, and the second end of the arc system can be positioned along the rail system.

In this embodiment, the arc system may be parallel railings that form an arc between the tower and the rail system. The resistance load may be weights connected to the carriage by a pulley system, or resistance bands may be used instead or, or in addition to, weights.

Still further, the carriage in this embodiment may includes ball bearings and U-shaped wheels with channels for engagement and movement along the arc system. Alternatively, the railings may include grooves in which projecting wheels of the carriage can roll.

Also in this embodiment, the carriage may include foot padding for user comfort and padding may also be placed on an opposite side to minimize or cushion impact with a back stop that can also be installed on the arc system. The back stop may be adjustable along the arc system to change a range of travel of the carriage.

Handrails may be installed along the arc system that are individually adjustable to accommodate different user heights, health, and mobility to provide stability. Likewise, a padded platform may be provided with the arc system for users to stand upon.

In another embodiment, the disclosure provides a method of using an arcing system for leg extensions. The method may include providing a tower having a height adjustment system; providing a rail system disposed proximate the tower; providing an arc system having a first end and a second end, the first end adjustably attached to the height adjustment mechanism, the second end adjustably attached to the rail system; providing a resistance load such as a selectable weight; and slidably connecting a carriage on the arc system and connecting the carriage to the resistance load.

The method may further include pushing the carriage along the arc system. Still further, a back stop may be attached to the arc system at a point or position to establish a range of travel of the carriage.

Additional objects and advantages of the present subject matter are set forth in, or will be apparent to, those of ordinary skill in the art from the description herein. Also, it should be further appreciated that modifications and variations to the specifically illustrated, referenced, and discussed features, processes, and elements hereof may be practiced in various embodiments and uses of the disclosure without departing from the spirit and scope of the subject matter. Variations may include, but are not limited to, substitution of equivalent means, features, or steps for those illustrated, referenced, or discussed, and the functional, operational, or positional reversal of various parts, features, steps, or the like. Those of ordinary skill in the art will better appreciate the features and aspects of the various embodiments, and others, upon review of the remainder of the specification.

BRIEF DESCRIPTION OF THE DRAWINGS

A full and enabling disclosure of the present subject matter, including the best mode thereof directed to one of ordinary skill in the art, is set forth in the specification, which refers to the appended figures, wherein.

DETAILED DESCRIPTION OF THE DISCLOSURE

Figure 1:
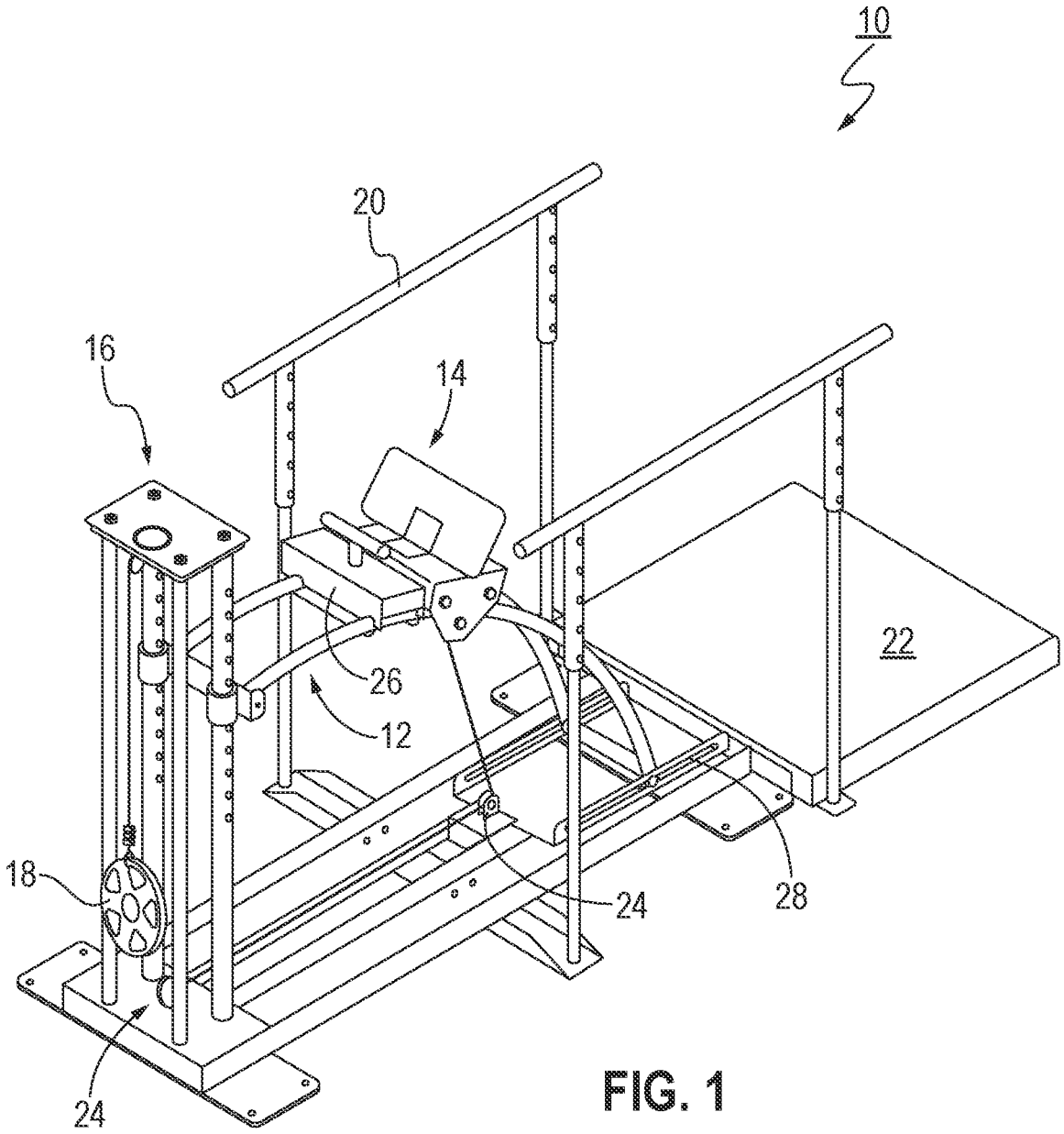
FIG. 1 is a top perspective view of an embodiment of the disclosure.

Detailed embodiments are disclosed herein; however, the disclosed embodiments are merely exemplary and may be embodied in various forms. Therefore, specific structural and functional details disclosed herein are not to be interpreted as limiting, but as bases for the claims and as a representative basis for teaching one skilled in the art to variously employ the exemplary embodiments of the present disclosure, as well as their equivalents.

Unless defined otherwise, all technical and scientific terms used herein have the same meaning as is commonly understood by one of ordinary skill in the art to which this disclosure belongs. In the event that there is a plurality of definitions for a term or acronym herein, those in this section prevail unless stated otherwise.

Wherever the phrases "for example," "such as," "including," and the like are used herein, the phrase "and without limitation" is understood to follow unless explicitly stated otherwise. Similarly, "an example," "exemplary," and the like are understood to be non-limiting.

The term "substantially" allows for deviations from the descriptor that do not negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

Unless the context clearly requires otherwise, throughout the description and the claims, the words "comprise," "comprising," and the like are to be construed in an inclusive sense as opposed to an exclusive or exhaustive sense; in the sense of "including, but not limited to."

The terms "comprising" and "including" and "having" and "involving" (and similarly "comprises," "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, et cetera. Thus, for example, "a device having components a, b, and c" means that the device includes at least components a, b, and c. Similarly, the phrase: "a method involving a, b, and c" means that the method includes at least steps a, b, and c.

Where a list of alternative component terms is used, e.g., "a structure such as 'a,' 'b,' 'c,' 'd,' or the like," or "a" or "b," such lists and alternative terms provide meaning and context for the sake of illustration, unless indicated otherwise. Also, relative terms such as "first," "second," "third," "left," "right," "front," "rear," et cetera are intended to identify or distinguish one component or feature from another similar component or feature, unless indicated otherwise herein.

When a list of element names are provided with a component or step element number, the names are understood as identifying, nonlimiting, alternative nomenclature for that component or step; e.g., "bird, poultry, or fowl 10" means element number 10 may mean and be referred to by any of the listed nomenclature.

The various embodiments of the disclosure and/or equivalents falling within the scope of the present disclosure overcome or ameliorate at least one of the disadvantages of the prior art.

Detailed reference will now be made to the drawings in which examples embodying the present subject matter are shown. The detailed description uses numerical and letter designations to refer to features of the drawings. The drawings and detailed description provide a full and written description of the present subject matter, and of the manner and process of making and using various exemplary embodiments, so as to enable one skilled in the pertinent art to make and use them, as well as the best mode of carrying out the exemplary embodiments. The drawings are not necessarily to scale, and some features may be exaggerated to show details of particular components. Thus, the examples set forth in the drawings and detailed descriptions are provided by way of explanation only and are not meant as limitations of the disclosure. The present subject matter thus includes any modifications and variations of the following examples as come within the scope of the appended claims and their equivalents.

Turning now to FIG. 1, an exemplary arcing exercise, flexibility, and rehabilitation station for hips and legs is designated broadly by the element number 10. The leg arcing station 10 may include an adjustable arc 12, a rolling carriage 14, an arc height adjustment tower 16, an adjustable weight system or selectable resistance load 18 (which may utilize a removable or detachable bar bell plate as shown, built-in selectable plates, rubber resistance bands, and the like), adjustable guide bars or handrails 20, a base or platform 22, a pulley system 24, an adjustable back stop 26, and an arc track or rail system 28. As explained in detail below, the adjustable arc 12 permits a user to develop strength and flexibility of the hip and leg muscles, particularly by forcing hip muscles to engage before an extension. More particularly, at least one embodiment as described herein forces activation of hip abductors during lifting and extension and activation of adductors during retraction.

Figure 2:
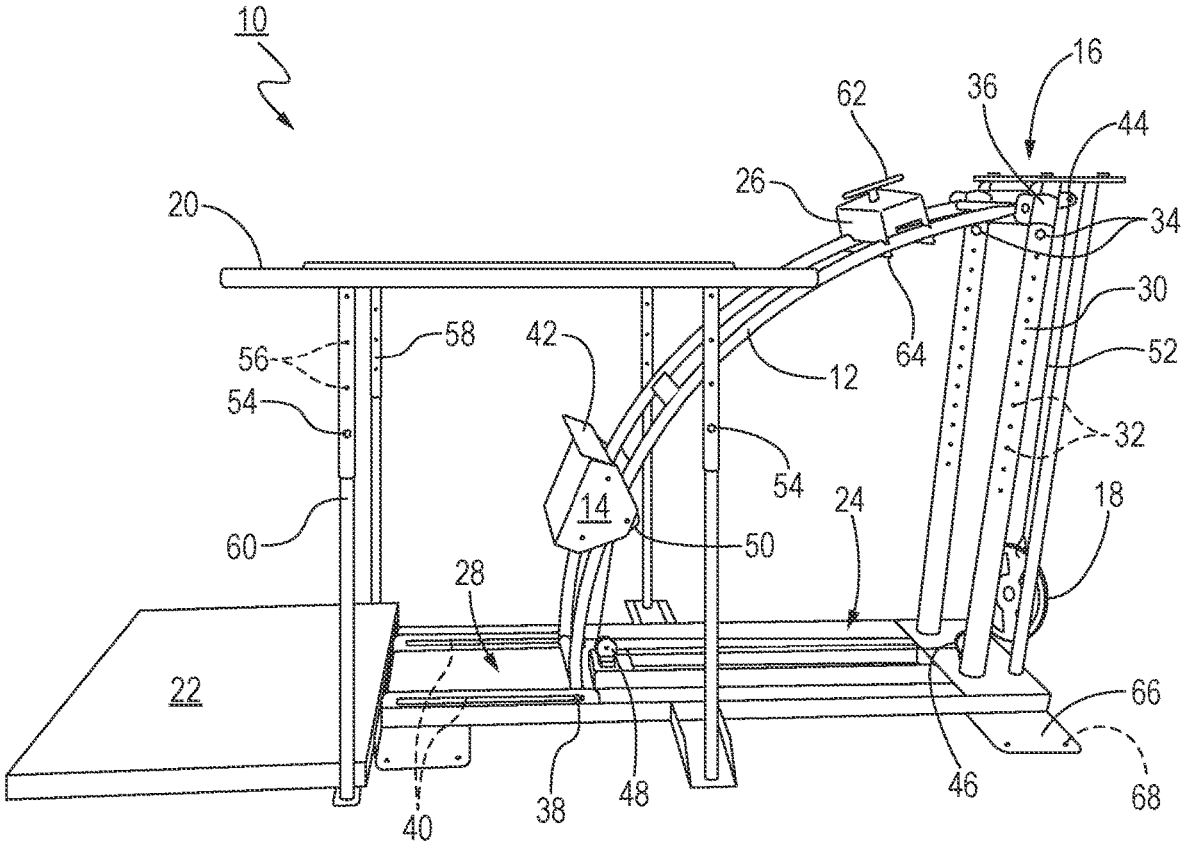
FIG. 2 is right-side elevational view of the embodiment as in FIG. 1, particularly showing an adjustable arc in a forward, elevated position and a rolling carriage in a static position.

FIG. 2 shows the leg arcing station 10 in a first, elevated, static position or state. Here, the adjustable arc 12 is a pair of parallel railings that are raised up and forward using the rail system 28 and bars 30, gradations or apertures 32, and locking pins 34 of the arc height adjustment tower 16. More particularly, a first end or top 36 of the arc 12 has been adjusted upward via the pins 34 and the apertures 32 in the bars 30 while a second end 38 slides along slots 40 in the rail system 28. A crank wheel or other height-adjustment mechanism can be used in the alternative or in addition to the pins 34 and the apertures 32 in the bars 30.

FIG. 2 further shows that the rolling carriage 14 may have a foot ledge or plate 42, which is shown here in a relaxed or static state with the adjustable weight system 18, related pulleys 44, 46, 48 and 50, and a cord, cable, or line 52 running therebetween also in static states. In this example, the independently adjustable handrails 20 are in a user-specified position with both rails 20 parallel and level with a floor or ground. The handrails 20 can be adjusted upward or downward and/or angled using pins 54 and apertures 56 in respective orthogonal sleeves 58 and complementary base rods or poles 60, which may be connected to the platform 22 directly or indirectly.

The carriage 14 in FIGS. 1 and 2 may utilize ball bearings and u-groove wheels to travel along the arc 12. Additionally, the carriage 14 may be constructed of light-weight aluminum and may further include cushioning on its foot plate 42 for comfort, as explained below. Similarly, the exemplary platform 22 may be metal and/or include a rubber, non-skid surface or mat for user comfort. Still further, the adjustable back stop 26 is shown adjusted to a desired position by an adjustment assembly such as a handle 62 and a slidable grip or clutch 64. In operation, the back stop 26 prevents a user with limited flexibility from over-extending and may include leather or other padding to cushion impact between the carriage 14 and the back stop 26 during use. Likewise, padding may be attached to the carriage 14 for additional cushioning. For added safety during use, feet or bases 66 with securement mechanisms such as bolts 68 may be used to secure the station 10 to the ground.

Figure 3:
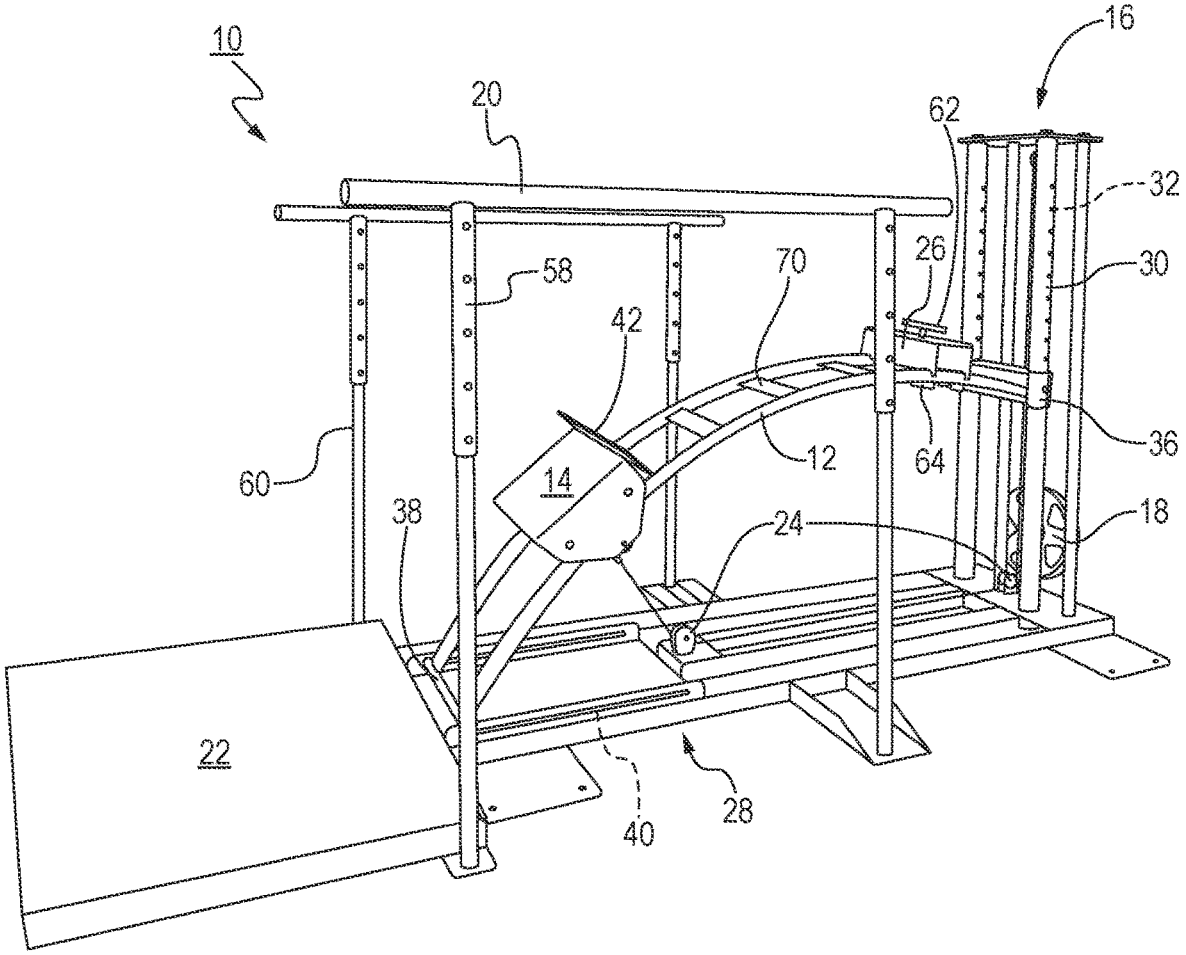
FIG. 3 is right-side perspective view of the embodiment as in FIG. 2, particularly showing the adjustable arc in a lower elevation position and the rolling carriage in the static position.
Figure 4:
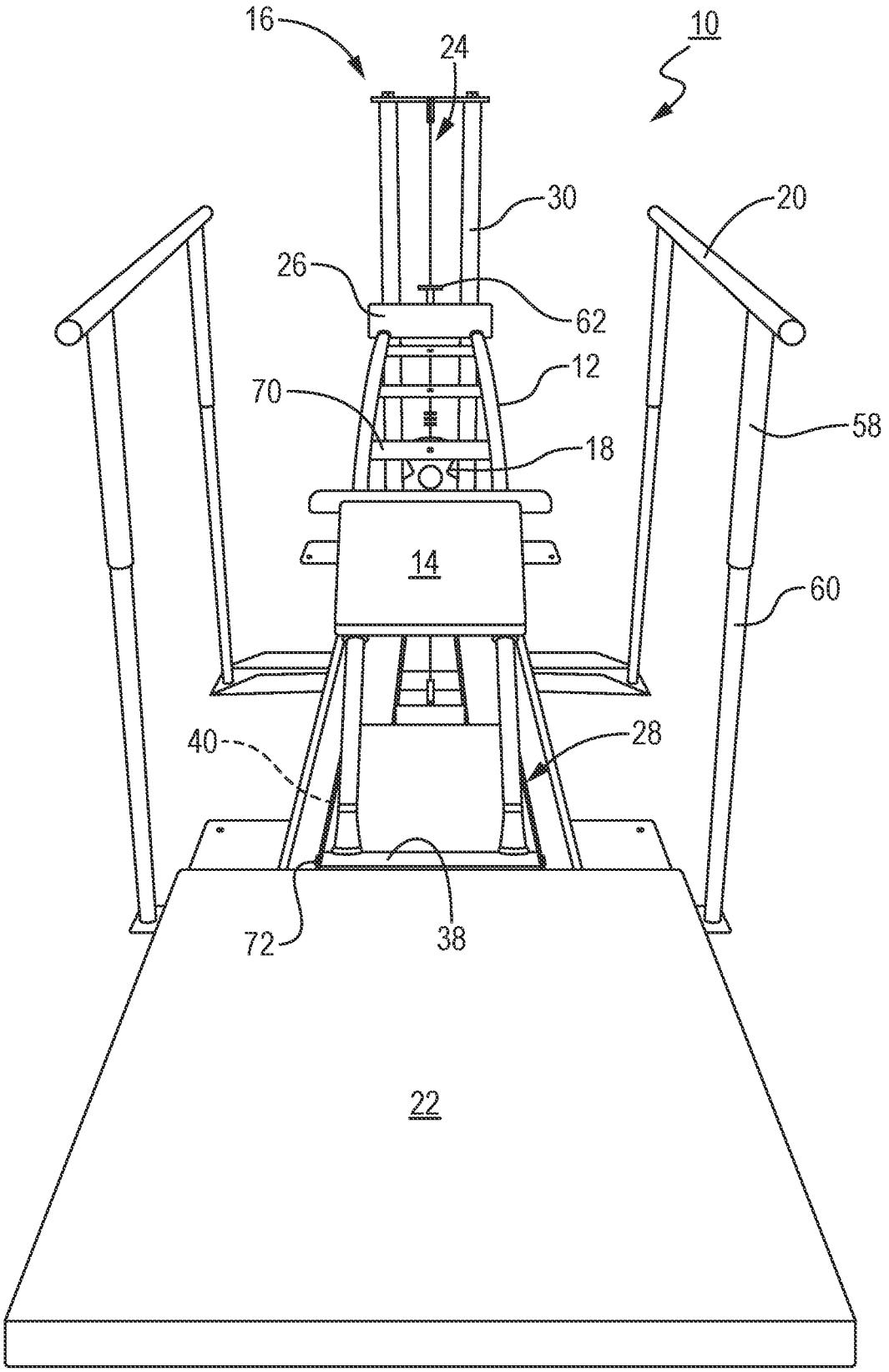
FIG. 4 is a rear perspective view of the embodiment as in FIG. 3.

With reference to FIGS. 3 and 4, the leg arcing station 10 is shown in a second, lowered, static position or state. Here, the first end 36 of the arc 12 has been lowered along the arc height adjustment tower 16 thereby moving the second or bottom end 38 of the arc 12 backward along the rail system 28 toward the platform 22. In this example, spacers 70 may be inserted at intervals along the arc 12 for additional rigidity and stability, and the end 38 of the arc 12 may include rolling projections or protrusions 72 that extend into and move along the slots 40 of the rail system 28, as particularly shown in FIG. 4.

FIGS. 3 and 4 further show that the arc 12 has been moved from its first most elevated position, as previously shown in FIG. 2, to its lowest position, which, in this example, is a differential height of eleven inches (11"). Of course, a variety of interim positions between the first elevated and second lowest positions are available, depending on user desires and needs. For instance, the first end 36 of the arc 12 could be lowered less than eleven inches, depending upon gradations 32 set into the bars 30 of the tower 16. Moreover, the height and adjustability of the arc 12 is not limited to this example, as overall lengths of the arc 12, the adjustment tower 16, and the rail system 28 may be increased for greater ranges or decreased for a more compact system. Still further, a lightweight version of the leg arcing station 10 manufactured from plastic or other lightweight material and/or using elastic bands instead of weighted plates 18 could be provided in which the arc 12 would be adjusted using stationary pivot points at the bottom of the arc 12, and the bottom of the tower 16 to permit the top end 36 of the arc 12 to slide along the bars 30 of the tower 16.

Figure 5:
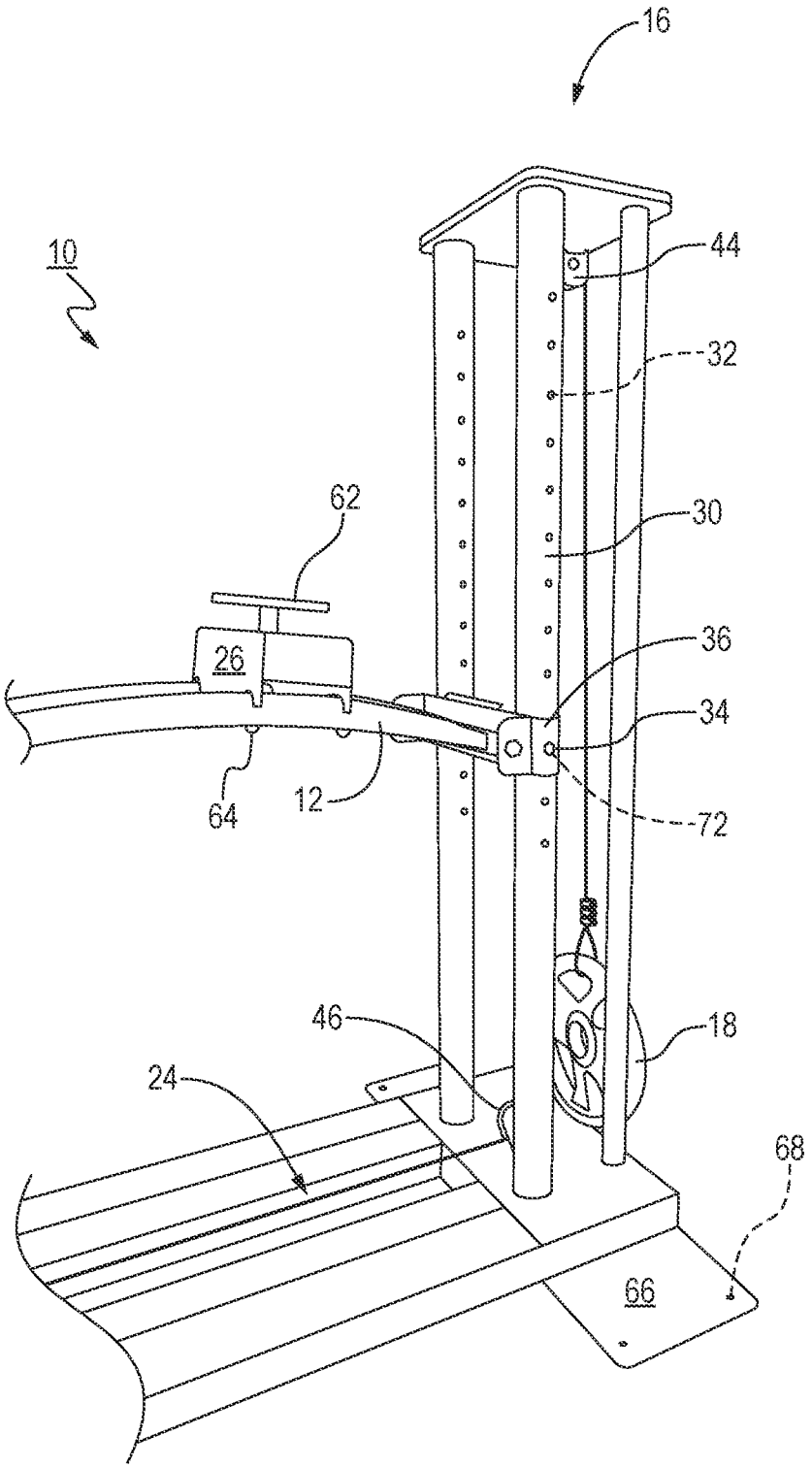
FIG. 5 is a partial, close-up view of the embodiment as in FIG. 3, particularly showing a forward adjustment point of the adjustable arc.

FIG. 5 most clearly shows the exemplary gradations 32 set into the tower 16 of the leg arcing station 10 by which the first end 36 of the arc 12 may be raised and lowered as introduced above. Here, complementary apertures 72 can be formed in the first end 36 through which the pins 34 can be inserted into the apertures 32 of the tower bars 30 to adjust and hold the arc 12 in a desired position. Either before or after adjusting the end 36 of the arc 12, the adjustable back stop 26 also can be adjusted using the handle 62 to loosen and tighten the clutch 64 to a desired point along the arc 12 as introduced above. Also noted above, the weighted plates 18 and the pulley system 24 in this example could be substituted or complemented with a rubber/elastic band or magnetic resistance system to create resistance and bases 66 can be used with bolts 68 to anchor the station 10 to ground for greater stability.

Figure 6:
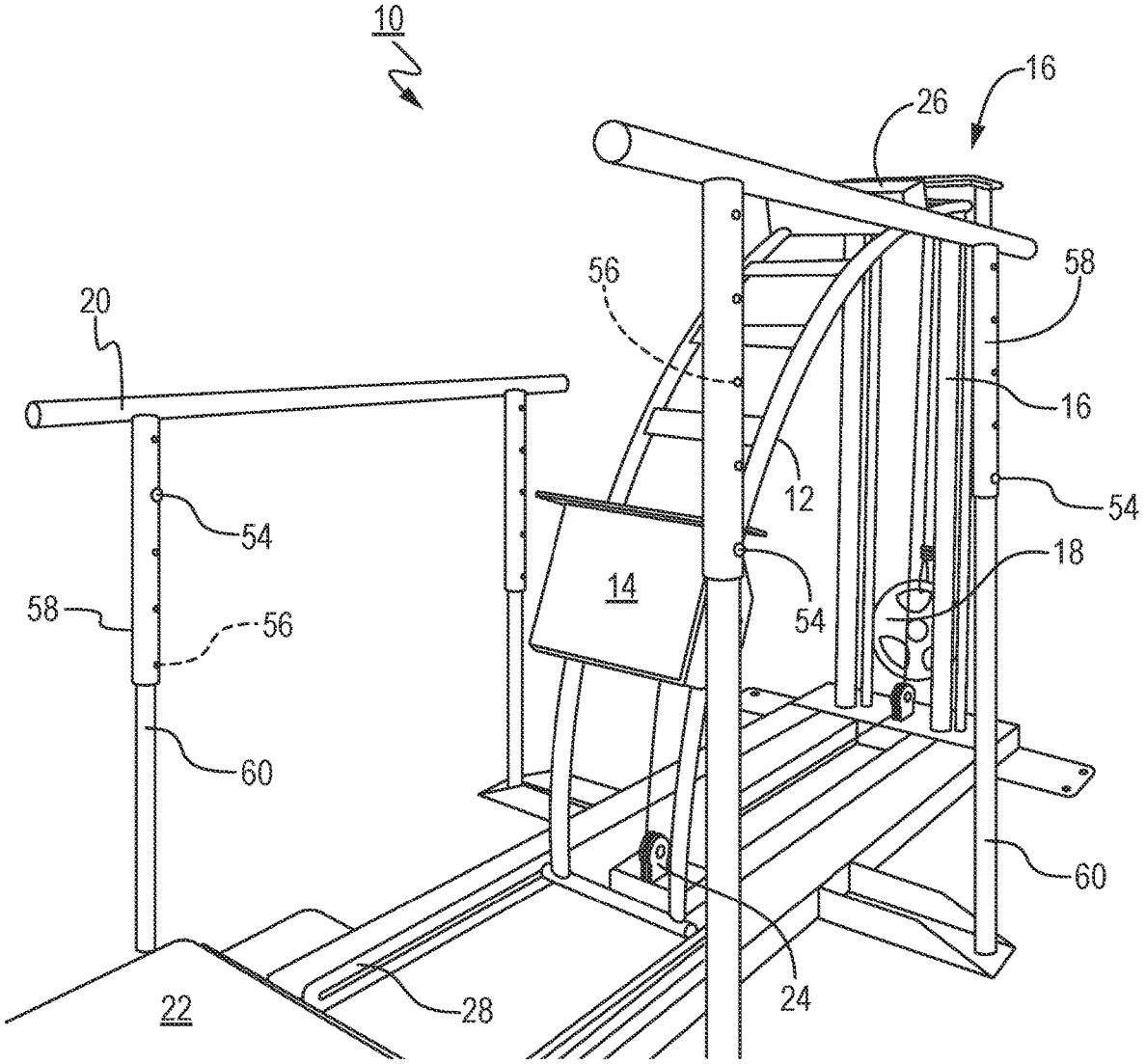
FIG. 6 is a partial, rear perspective view of the embodiment similar to FIG. 2, particularly showing adjustability of stability arms.

Turning now to FIG. 6, the leg arcing station 10 is shown in its first, highest elevated position whereby the arc 12 has been moved up and along the arc height adjustment tower 16 and forward along the rail system 28 toward the weight system 18 and away from the platform 22. In this example, the carriage 14 is in a relaxed state on the arc 12, and the back stop 26 is in an uppermost position. As explained above, the back stop 26 can be moved to a lower position on the arc 12 to limit travel of the carriage 14 to prevent overextension for some users, or it can be removed from the arc 12 if a particular user desires full extension. Also by way of example, the user may adjust the handrails 20 to different heights. For instance, one rail 20 may be lower than the other by lowering a set of sleeves 58 onto the complementary rods 60 and placing the pins 54 thorough the desired apertures 56 while leaving the other handrail 20 at a higher position.

Figure 7:
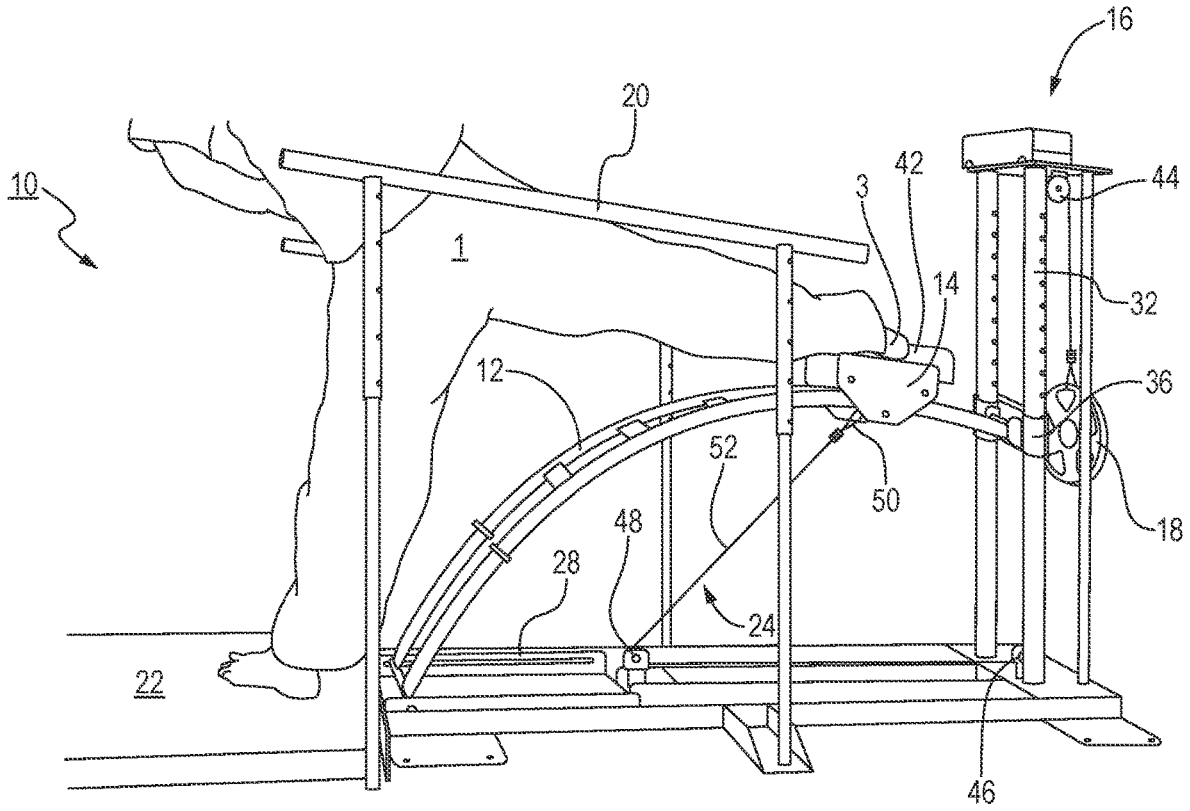
FIG. 7 is a partial, right-side perspective view of the embodiment as in FIG. 3, particularly showing the rolling carriage in an engaged position.

FIG. 7 shows the leg arcing station 10 being used in its second, lowest position whereby the arc 12 has been moved downward on the arc height adjustment tower 16 and backward along the rail system 28 toward the platform 22 upon which a user 1 stands. In this example, the back stop 26 has been removed from the arc 12 by the user 1 to achieve a full range of motion and complete extension of the engaged hip and leg. More particularly, the foot ledge 42 briefly introduced above has been engaged by a right foot 3 of the user 1 thereby pushing the carriage 14 forward along the arc 12. The pushing action on the carriage 14 causes the pulleys 44, 46, 48 and 50 to engage and lift the weight 18 via the interlinked cable 52, which in turn develops strength and flexibility of the hip and leg muscles. For stability, the user 1 may hold onto handrails 20.

Figure 8:
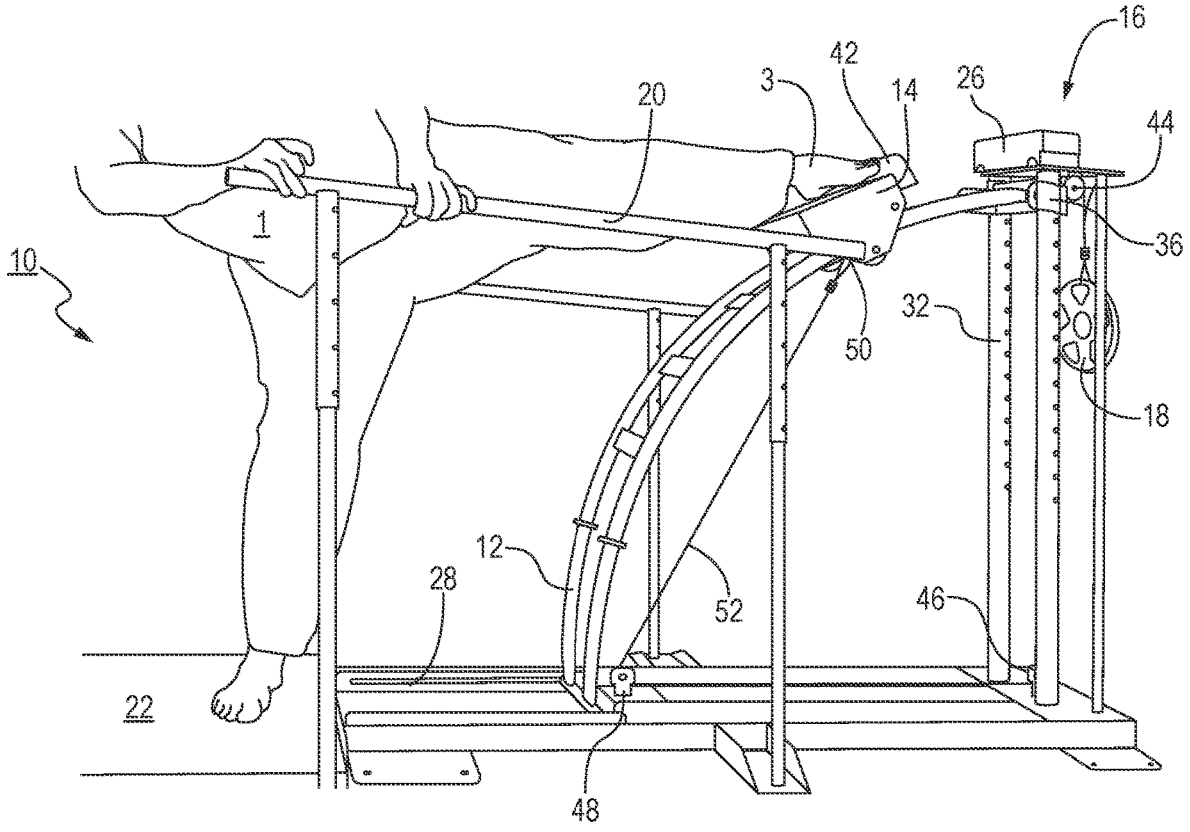
FIG. 8 is a partial, right-side perspective view of the embodiment as in FIG. 2, particularly showing the rolling carriage in the engaged position.

FIG. 8 shows the leg arcing station 10 in use in its first, highest position whereby the arc 12 has been moved up the arc height adjustment tower 16 and forward along the rail system 28 toward the weight system 18 and away from the platform 22 upon which the user 1 is standing. Similar to FIG. 7, the back stop 26 has been removed from the arc 12 to achieve greater extension of an engaged hip and leg. Also similar to FIG. 7, the foot ledge 42 of the carriage 14 has been engaged by the user's foot 3, except that in this example the user 1 is engaging with the left foot 3 and can be seen holding the rail 20 for additional balance. Again, this pushing action of the carriage 14 along the arc 12 causes the pulleys 44, 46, 48 and 50 to engage and lift the weight 18 via the cable 52 to exercise and/or rehabilitate the hip and leg muscles of the user 1.

Exemplary embodiments as disclosed herein may include but are not limited to:

EMBODIMENT 1: An arcing system for leg extensions, comprising a tower having a height adjustment mechanism; a rail system; an arc system having a first end and a second end, the first end adjustably attached to the height adjustment mechanism and the second end adjustably attached to the rail system; a resistance load; and a carriage slidably disposed on the arc system and connected to the resistance load such that when the carriage is engaged by a user and pushed along the arc system, the resistance load opposes exertion by the user.

EMBODIMENT 2: The arcing system for leg extensions as in embodiment 1, wherein the first end of the arc system can be raised and lowered on the height adjustment mechanism.

EMBODIMENT 3: The arcing system for leg extensions as in embodiments 1 or 2, wherein the second end of the arc system can be positioned along the rail system.

EMBODIMENT 4: The arcing system for leg extensions as in any of the foregoing embodiments, wherein the arc system are railings disposed parallel to each other and forming an arc between the tower and the rail system.

EMBODIMENT 5: The arcing system for leg extensions as in any of the foregoing embodiments, wherein the resistance load is a plurality of weights or resistance bands.

EMBODIMENT 6: The arcing system for leg extensions as in any of the foregoing embodiments, wherein the resistance load is a plurality of weights connected to the carriage by a pulley system.

EMBODIMENT 7: The arcing system for leg extensions as in any of the foregoing embodiments, wherein the carriage includes ball bearings and U-shaped wheels with channels for engagement and movement along the arc system.

EMBODIMENT 8: The arcing system for leg extensions as in any of the foregoing embodiments, wherein the carriage includes foot padding.

EMBODIMENT 9: The arcing system for leg extensions as in any of the foregoing embodiments, further comprising handrails disposed proximate the arc system, the handrails being individually adjustable to accommodate a user.

EMBODIMENT 10: The arcing system for leg extensions as in any of the foregoing embodiments, further comprising a platform disposed proximate the arc system for a user to stand upon.

EMBODIMENT 11: The arcing system for leg extensions as in any of the foregoing embodiments, further comprising a back stop disposed on the arc system, the back stop being adjustable along the arc system to change a range of travel of the carriage.

EMBODIMENT 12: A method of using an arcing system for leg extensions, the method comprising providing a tower having a height adjustment system; providing a rail system disposed proximate the tower; providing an arc system having a first end and a second end, the first end adjustably attached to the height adjustment mechanism, the second end adjustably attached to the rail system; providing a resistance load, preferably a selectable weight; and slidably connecting a carriage on the arc system and connecting the carriage to the resistance load.

EMBODIMENT 13: The method as in embodiment 12, further comprising pushing the carriage along the arc system.

EMBODIMENT 14: The method as in embodiment 13, further comprising attaching a back stop to the arc system, more particularly the back stop positioned at a point to establish a range of travel of the carriage.

While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

The invention claimed is:

1. An arcing system for leg extensions, comprising:

a tower having a height adjustment mechanism;

a rail system;

an arc system having a first end and a second end, the first end adjustably attached to the height adjustment mechanism, the second end adjustably attached to the rail system, wherein a concavity of the arc system faces towards a ground surface upon which the arcing system for leg extensions is disposed;

a resistance load; and a carriage slidably disposed on the arc system and connected to the resistance load such that when the carriage is engaged by a user and pushed along the arc system, the resistance load opposes exertion by the user.

2. The arcing system for leg extensions as in claim 1, wherein the first end of the arc system can be raised and lowered on the height adjustment mechanism.

3. The arcing system for leg extensions as in claim 1, wherein the second end of the arc system is configured for positioning along the rail system.

4. The arcing system for leg extensions as in claim 1, wherein the arc system comprises railings disposed parallel to each other forming an arc between the tower and the rail system.

5. The arcing system for leg extensions as in claim 1, wherein the resistance load is a detachable weight.

6. The arcing system for leg extensions as in claim 1, wherein the resistance load is a plurality of weights connected to the carriage by a pulley system.

7. The arcing system for leg extensions as in claim 1, wherein the carriage includes foot padding.

8. The arcing system for leg extensions as in claim 1, further comprising handrails disposed proximate to the arc system, the handrails being independently adjustable.

9. The arcing system for leg extensions as in claim 1, further comprising a platform disposed proximate to the arc system for the user to stand upon.

10. The arcing system for leg extensions as claim 1, further comprising a back stop disposed on the arc system, the back stop being adjustable along the arc system to change a range of travel of the carriage.

11. An arcing system for leg extensions, comprising:

a tower having a height adjustment system;

a rail system;

an arc system having a first end and a second end, the first end adjustably attached to the height adjustment mechanism, the second end adjustably attached to the rail system, wherein a concavity of the arc system faces towards a ground surface upon which the arcing system for leg extensions is disposed;

a resistance load;

a carriage slidably disposed on the arc system and connected to the resistance load such that when the carriage is engaged by a user and pushed along the arc system, the resistance load opposes exertion by the user; and a back stop disposed on the arc system, the back stop being adjustable along the arc system to change a range of travel of the carriage.

12. The arcing system for leg extensions as in claim 11, wherein the carriage includes foot padding.

13. The arcing system for leg extensions as in claim 11, wherein the backstop is detachable from the arc system.

14. The arcing system for leg extensions as in claim 11, further comprising handrails disposed proximate to the arc system.

15. The arcing system for leg extensions as in claim 11, further comprising a platform disposed proximate to the arc system for the user to stand upon.

16. A method of using an arcing system for leg extensions, the method comprising:

providing a tower having a height adjustment system;

providing a rail system disposed proximate to the tower;

providing an arc system having a first end and a second end, the first end adjustably attached to the height adjustment mechanism, the second end adjustably attached to the rail system, wherein a concavity of the arc system faces towards a ground surface upon which the arcing system for leg extensions is disposed;

providing a resistance load; and slidably connecting a carriage on the arc system and connecting the carriage to the resistance load.

17. The method as in claim 16, wherein the resistance load is a selectable weight.

18. The method as in claim 16, further comprising pushing the carriage along the arc system.

19. The method as in claim 16, further comprising attaching a back stop to the arc system.

20. The method as in claim 16, further comprising attaching a back stop to the arc system at a point to establish a range of travel of the carriage.

* * * * *